US009765471B2

(12) United States Patent
Kim et al.

(10) Patent No.: US 9,765,471 B2
(45) Date of Patent: Sep. 19, 2017

(54) DRYER

(71) Applicant: LG ELECTRONICS INC., Seoul (KR)

(72) Inventors: Jongseok Kim, Seoul (KR); Daeyun Park, Seoul (KR); Byeongjo Ryoo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/962,324

(22) Filed: Dec. 8, 2015

(65) Prior Publication Data

US 2016/0160424 A1 Jun. 9, 2016

(30) Foreign Application Priority Data

Dec. 9, 2014 (KR) ..... 10-2014-0176069

(51) Int. Cl.
*D06F 58/04* (2006.01)

(52) U.S. Cl.
CPC ..... *D06F 58/04* (2013.01)

(58) Field of Classification Search
CPC ..... D06F 58/00; D06F 58/04; D06F 58/12; F26B 19/00; F26B 21/00
USPC ..... 34/109, 595, 601, 610; 68/5 C, 5 R; 8/159
See application file for complete search history.

(56) References Cited

U.S. PATENT DOCUMENTS 2,399,702 A * 5/1946 White ..... H03J 5/143 74/568 R
3,316,659 A 5/1967 Lauck
3,503,137 A * 3/1970 Wilson ..... A24B 1/02 131/303
3,555,701 A 1/1971 Hubbard
3,696,521 A 10/1972 Hubbard
4,617,743 A * 10/1986 Barnard ..... F26B 25/14 34/109
5,743,025 A * 4/1998 Jordan, Jr. ..... D06F 58/04 34/600
5,852,881 A * 12/1998 Kuroda ..... D06F 58/28 34/527

(Continued)

FOREIGN PATENT DOCUMENTS

CN 102108622 6/2011
EP 3 031 969 * 6/2016

(Continued)

OTHER PUBLICATIONS

Extended European Search Report issued in European Application No. 15198378.0 on May 17, 2016, 8 pages.

(Continued)

*Primary Examiner* — Stephen M Gravini
(74) *Attorney, Agent, or Firm* — Fish & Richardson P.C.

(57) ABSTRACT

A dryer includes a cabinet that defines an outer appearance of the dryer and has at least one opening, a main drum rotatably disposed in the cabinet and configured to accommodate an object to be dried, a door portion coupled to the cabinet and configured to open and close the opening of the cabinet, and a sub drum rotatably mounted to the door portion and extending toward an inner space of the cabinet. The sub drum defines an accommodation space that is separated from the inner space of the main drum.

20 Claims, 7 Drawing Sheets

(56) References Cited

U.S. PATENT DOCUMENTS

| | | | | |
|---|---|---|---|---|
| 6,212,792 | B1 * | 4/2001 | Bier | D06F 58/04 34/109 |
| 7,627,960 | B2 * | 12/2009 | Beyerle | D06F 58/04 34/602 |
| 7,644,515 | B2 * | 1/2010 | Doh | D06F 58/22 34/603 |
| 7,661,203 | B2 * | 2/2010 | Fumagalli | D06F 37/04 249/64 |
| 7,694,434 | B2 * | 4/2010 | Lee | D06F 58/04 34/607 |
| 7,913,419 | B2 * | 3/2011 | Tomasi | D06F 29/00 211/85.3 |
| 7,946,057 | B2 * | 5/2011 | Dittmer | D06F 58/20 34/597 |
| 7,987,615 | B2 * | 8/2011 | Han | D06F 58/20 165/119 |
| 7,992,322 | B2 * | 8/2011 | Kim | D06F 58/04 126/85 B |
| 8,046,933 | B2 * | 11/2011 | Yoo | D06F 58/08 34/599 |
| 8,347,523 | B2 * | 1/2013 | Chung | D06F 58/04 34/130 |
| 8,776,395 | B2 * | 7/2014 | Tatar | D06F 39/14 34/242 |
| 9,194,073 | B2 * | 11/2015 | Kwon | D06F 25/00 |
| 9,249,534 | B2 * | 2/2016 | Im | D06F 33/02 |
| 9,546,442 | B2 * | 1/2017 | Underly | D06F 29/00 |
| 2014/0182159 | A1 * | 7/2014 | Shin | D06F 58/04 34/130 |
| 2015/0299931 | A1 * | 10/2015 | Yang | D06F 39/005 362/23.19 |
| 2016/0160420 | A1 * | 6/2016 | Lv | D06F 31/00 68/27 |
| 2016/0160424 | A1 * | 6/2016 | Kim | D06F 58/04 34/109 |

FOREIGN PATENT DOCUMENTS

| | | |
|---|---|---|
| JP | S06-096299 | 5/1985 |
| JP | H04-307098 | 10/1992 |
| KR | 10-2003-0049861 A | 6/2003 |
| KR | 10-0701329 B1 | 3/2007 |
| KR | 20-0464726 Y1 | 1/2013 |
| KR | 10-2013-0044609 A | 5/2013 |

OTHER PUBLICATIONS

Korean Office Action dated Jul. 9, 2015 for Korean Application No. 10-2014-0176069, 6 pages.

Chinese Office Action in Chinese Application No. 201510873560.2, dated Jul. 24, 2017, 13 pages (with English translation).

* cited by examiner

DRYER

CROSS-REFERENCE TO RELATED APPLICATION

Pursuant to 35 U.S.C. §119(a), this application claims the benefit of earlier filing date and right of priority to Korean Application No. 10-2014-0176069, filed on Dec. 9, 2014, the contents of which is incorporated by reference herein in its entirety.

FIELD

The present disclosure relates to a dryer and a method for controlling the same, in particular a dryer having a dehumidifying module mounted thereto.

BACKGROUND

Generally, a clothes dryer is an apparatus that can dry, or evaporate moisture in, the laundry by, for example, blowing a hot blast of air generated by a heater into a drum.

The clothes dryer may be classified into an exhausting type clothes dryer and a condensing type clothes dryer, according to whether wet air having passed through the drum after a drying operation is further circulated or not. The clothes dryer may be operated as follows. First, an object to be dried may be accommodated in the drum, and a hot blast of air may be introduced into the drum by a heater, a heat pump, etc. Due to the hot blast of air, the wet object that is in the drum can be dried.

Because the drum in a conventional clothes dryer has a single space, it may not be possible to separately dry objects according to a type of the object to be dried. In some cases, when the amount of laundry to be dried is small, drying efficiency may be drastically lowered due to a large empty volume inside the drum.

SUMMARY

According to one aspect, a dryer includes a cabinet that defines an outer appearance of the dryer and has at least one opening, a main drum rotatably disposed in the cabinet and configured to accommodate an object to be dried, a door portion coupled to the cabinet and configured to open and close the opening of the cabinet, and a sub drum rotatably mounted to the door portion and extending toward an inner space of the cabinet. The sub drum defines an accommodation space that is to separated from the inner space of the main drum.

Implementations according to this aspect may include one or more of the following features. For example, the door portion may include a lid member having a front window, and an accommodation member hinge-coupled to the lid member and defining a space for accommodating the sub drum. The accommodating member may be configured to open and close the opening of the cabinet. The sub drum may be configured to be detachably mounted to the lid member and the accommodation member. In some cases, the lid member may include a rotation protrusion protruding toward the inner space of the cabinet, and the sub drum may include a protrusion accommodation portion that corresponds to the rotation protrusion, the protrusion accommodation portion being configured to rotatably receive the rotation protrusion. The door portion may include a motor configured to generate a rotational force, and a gear unit connected to one end of the motor and configured to be rotated by the motor, the gear unit having a saw teeth shape. The sub drum may include a sub drum gear located on an outer circumferential surface of the sub drum, the sub drum gear being configured to be engaged with and rotated by the gear unit.

In some cases, the dryer according to this aspect may further include a first passage defining a first flow path along which air is discharged out of the main drum, a second passage defining a second flow path along which air is discharged out of the sub drum, an exhaustion passage defining an exhaustion flow path where outlets of the first and second flow paths meet, and a filter unit disposed at the exhaustion flow path and configured to filter foreign materials from the air discharged out of the first and second flow paths. Also, the dryer may further include a damper unit that is rotatably mounted in the exhaustion flow path, the damper unit being configured to selectively open and close each outlet of the first flow path and the second flow path. The damper unit may be configured to open the second flow path based on the object to be dried being accommodated in the main drum, such that an area of air flow is increased compared to the second flow path being closed. In some cases, the damper unit may be configured to block the first flow path based on the object to be dried being accommodated in only the sub drum.

In some implementations, the cabinet may further include a control panel unit disposed above the opening and configured to be manipulated by a user, and the control panel unit may include a first dial for setting a drying mode of the main drum, and a second dial for setting a drying mode of the sub drum. Moreover, the first and second dials may be configured to be rotatable by a user's manipulation, and the first and second dials may be disposed to be concentric with each other. In some cases, the control panel unit may further include a first LED configured to be turned on and off in response to an operation of the first dial, and a second LED configured to be turned on and off in response to an operation of the second dial, while the first and second LEDs may be configured, based on both the first and second dials being set to the drying mode, to be turned on. The main drum and the sub drum may be configured to be rotatable at different speeds from each other. The second dial may be configured to control a temperature of air introduced into the sub drum.

Additionally, the damper unit may be configured to block the second flow path based on the object to be dried being accommodated in only the main drum. In some cases, a rear surface of the accommodation member may define a plurality of holes, the plurality of holes being configured to allow passage of air from the main drum to the accommodation member. Also, the sub drum may define a plurality of holes that are configured to allow passage of air from the main drum to the sub drum. Rear or side surfaces of the sub drum may define a plurality of holes that are configured to allow passage of air from the main drum to the sub drum. The main drum and the sub drum may be configured to be operated simultaneously. The main drum and the sub drum may be configured to be operated independently from each other.

DETAILED DESCRIPTION

Figure 1:
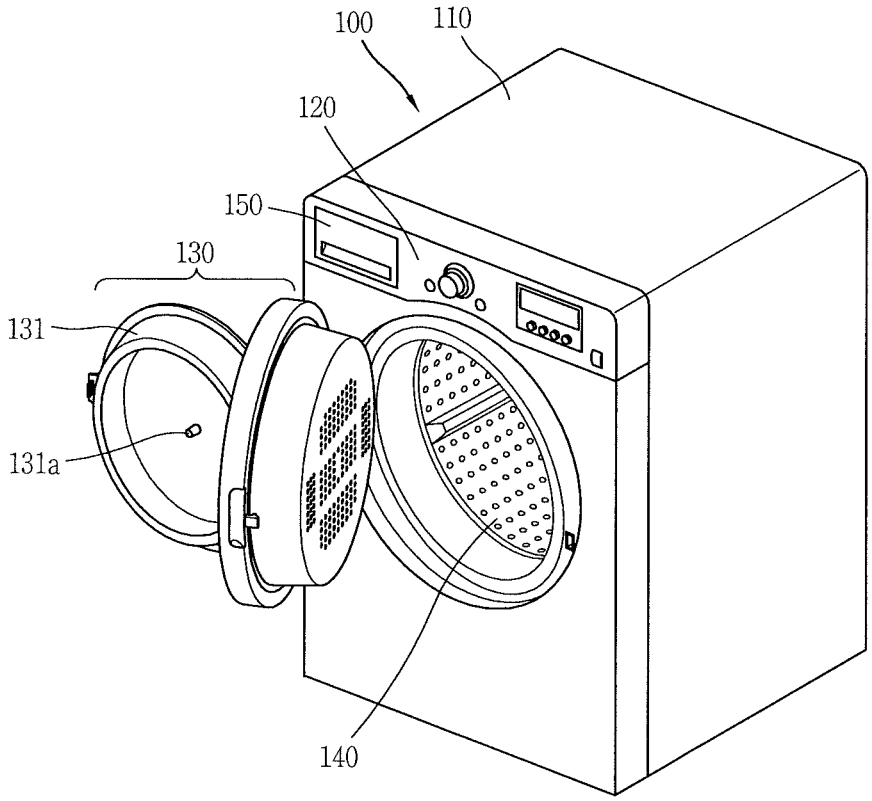
FIG. 1 is a schematic view illustrating an example dryer.

FIG. 1 is a schematic view illustrating an example dryer according to one implementation.

Referring to FIG. 1, the dryer 100 includes a cabinet 110 forming an outer appearance of the dryer 100, and a main drum 140 rotatably installed in the cabinet 110 and having a plurality of lifters protruding from an inner circumferential surface of the main drum 140. An introduction opening, through which laundry to be dried is introduced into the cabinet 110, is formed on a front surface of the cabinet 110.

The introduction opening may be opened or closed by a door portion 130, and a control panel unit 120 having various types of manipulation buttons for manipulating the dryer and a display unit, may be disposed above the introduction opening. A drawer 150 may be provided at one side of the control panel unit 120, and a liquid to be injected into the main drum 140 may be stored in the drawer 150.

The door portion 130 may include a lid member 131, and an accommodation member 133 (refer to FIG. 2) that can be opened or closed by the lid member.

The accommodation member may be designed to open and close the introduction opening of the dryer. The lid member 131 may be formed to open and close the accommodation member.

Figure 2:
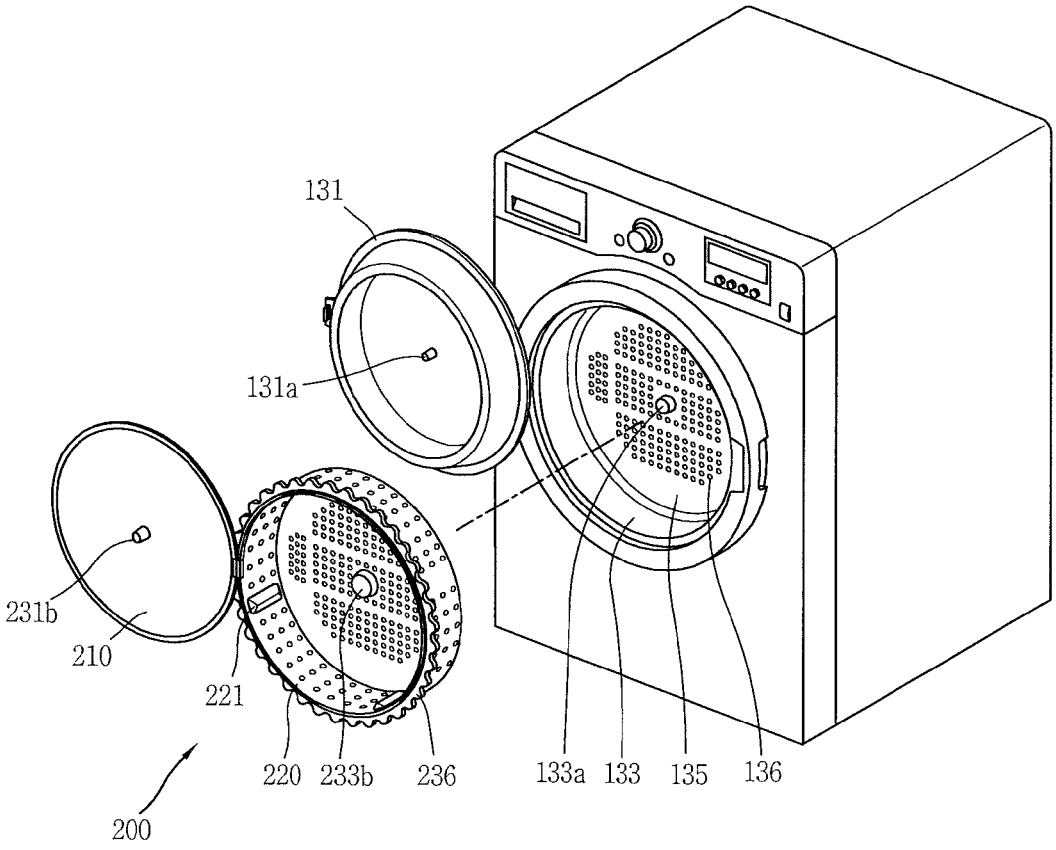
FIG. 2 is a schematic view illustrating an example sub drum that has been separated from a door portion of the dryer of FIG. 1.

FIG. 2 is a schematic view illustrating an example sub drum that has been separated from the door portion of the dryer.

Referring to FIG. 2, the dryer according to one implementation includes the cabinet 110 (refer to FIG. 1), the main drum 140 (refer to FIG. 1), the door portion 130 (refer to FIG. 1), and a sub drum 200.

The cabinet forms the outer appearance of the dryer, and at least one surface thereof is open.

The main drum 140 (refer to FIG. 1) is rotatably disposed in the cabinet, and is configured to accommodate therein an object to be dried.

The door portion may be rotatably attached to the cabinet, and is configured to open and close the opening of the cabinet.

The sub drum 200 is rotatably mounted to the door portion toward the inside of the cabinet, and has a separate accommodation space from an inner space of the main drum 140 such that an object to be dried can be accommodated in the accommodation space.

As aforementioned, the door portion 130 may include the lid member 131, and the accommodation member 133.

The lid member 131 may include a front window, and the lid member 131 may further include a frame which encloses the front window.

The front window may include a rotation protrusion 131*a* protruding toward the inside of the cabinet, i.e., the inside of the drum. When the lid member is closed after the sub drum 200 has been accommodated in the accommodation member 133, the rotation protrusion may be fitted into a protrusion accommodation portion 231*b* of the sub drum 200.

The accommodation member 133 may be hinge-coupled to the lid member 131. The accommodation member 133 forms a space for accommodating the sub drum 200, and is configured to open and close the opening of the cabinet.

The sub drum 200 may be detachably mounted to the lid member and the accommodation member 133. The sub drum 200 may include the protrusion accommodation portion 231*b* formed in correspondence to the rotation protrusion 131*a* such that the rotation protrusion 131*a* may be rotatably fitted into the protrusion accommodation portion 231*b*.

The sub drum 200 may include a sub drum lid member 210, and a sub drum body 220.

The sub drum body 220 is provided with a space where an object to be dried having a small volume can be accommodated. Generally, the sub drum body 220 has a similar function and structure to the drum, but has a smaller size. The sub drum body 220 may accommodate therein an object to be dried having a small volume, such as socks or underwear.

The sub drum lid member 210 may be formed to open and close the sub drum body 220. As illustrated in the drawings, the sub drum lid member 210 may be rotatably connected to the sub drum body 220 via, for example, a hinge.

The protrusion accommodation portion 231*b* may be formed at the sub drum lid member 210. A sub drum lift 221 may be formed in the sub drum body 220.

A plurality of holes 136 may be provided on a rear surface 135 of the accommodation member 133. Hot blast of air, which is introduced into the main drum 140, may be transferred to the sub drum 200 through the holes. A plurality of holes may be formed at the sub drum 200 such that the hot blast of air is transferred to the sub drum body 220.

An accommodation member protrusion 133*a* may be protruding from the rear surface 135 of the accommodation member 133. And an accommodation member protrusion accommodation portion 233*b* may be recessed from a rear surface of the sub drum body 220, such that the accommodation member protrusion 133*a* is accommodated therein.

Due to the rotatable coupling between the protrusions 131*a*, 133*a* and the accommodation portions 231*b*, 233*b*, the sub drum 200 accommodated in the accommodation member 133 may be rotatable.

Figure 3:
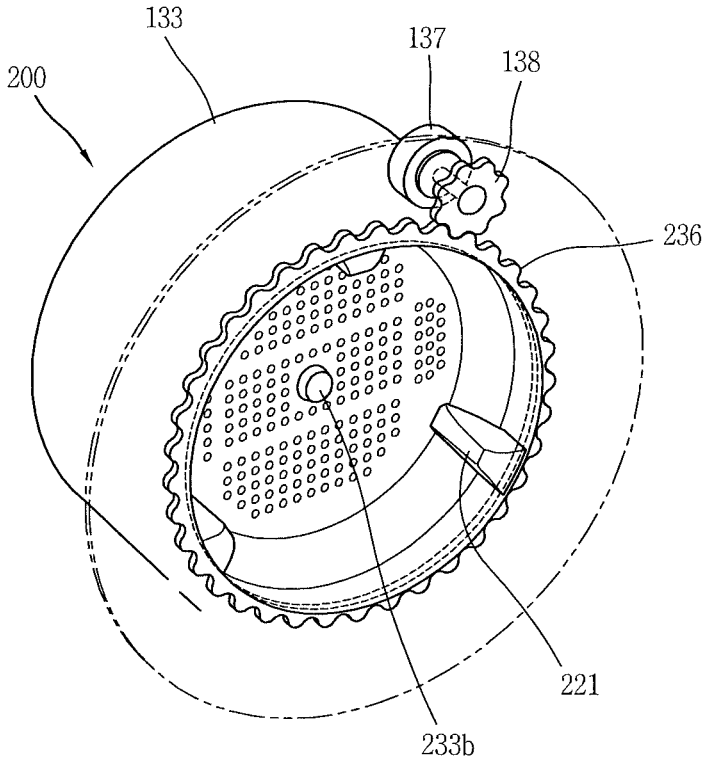
FIG. 3 is a conceptual view illustrating an example coupled state of the sub drum of FIG. 2 to a motor provided in the door portion, in a case where the sub drum is mounted to the inside of the door portion.

FIG. 3 is a conceptual view illustrating an example coupled state of the sub drum 200 to a motor 137 provided in the door portion, in a case where the sub drum 200 is mounted to the inside of the door portion.

Referring to FIG. 3, the door portion may include the motor 137 and a gear unit 138. The motor may generate a rotational force by receiving electric power.

The gear unit 138 may be connected to one end of the motor so as to be rotatable by the motor 137. The gear unit 138 may be formed to have a saw teeth shape or a concaved-convex shape so as to be engaged with a sub drum gear 236.

The sub drum 200 may include the sub drum gear 236 formed on an outer circumferential surface of the sub drum 200 so as to be engaged with the gear unit 138. In some cases, the sub drum gear 236 may be formed on an outer circumference of the sub drum body 220.

The sub drum and the gear unit are shown disposed such that the gear unit 138 and the sub drum gear 236 are engaged with each other when the sub drum 200 is accommodated in the accommodation member 133. Once a drying process is started, the motor 137 is rotated and thus the sub drum 200 can be rotated in the accommodation member 133.

In this case, the aforementioned protrusions 131*a*, 133*a* and the accommodation portions 231*b*, 233*b* may act as a rotation shaft.

Figure 4A:
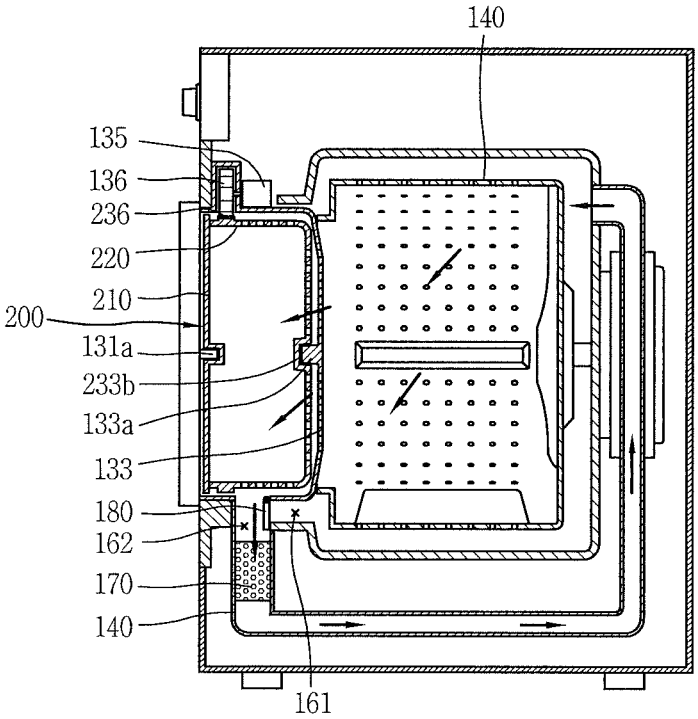
FIGS. 4A and 4B are sectional views illustrating an example movement of a damper unit configured to selectively open and close a first flow path or a second flow path, respectively.
Figure 4B:
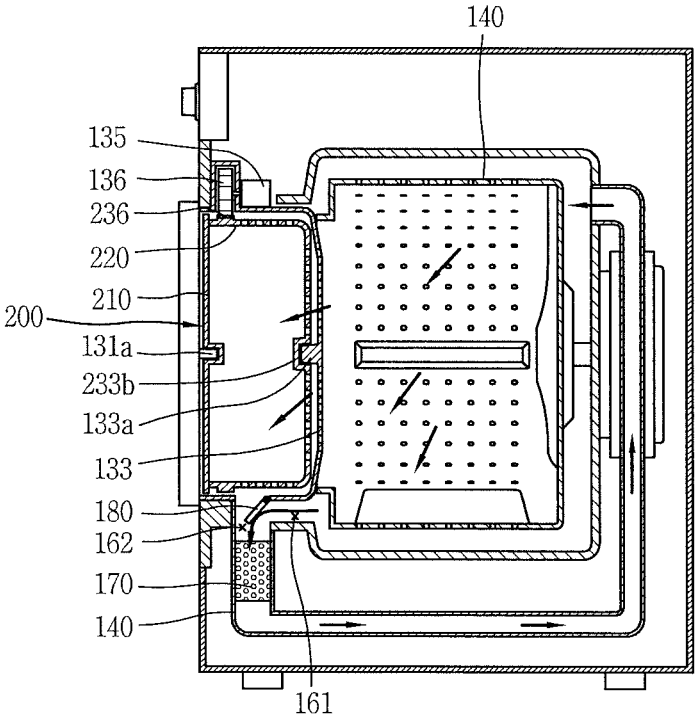

FIGS. 4A and 4B are sectional views illustrating example movements of a damper unit 180 configured to selectively open and close a first flow path 161 or a second flow path 162. More specifically, FIG. 4A illustrates a blocked state of the first flow path 161 along which air is discharged from the main drum 140 to the outside, and FIG. 4B illustrates an open state of the first flow path 161 and the second flow path 162.

As illustrated, air may be introduced from a rear surface of the sub drum body 220, and then may be discharged to the outside through a lower part of the sub drum 200. Referring also back to FIG. 2, the sub drum body 220 may be provided with a plurality of holes through which air flows, on a rear surface and side surfaces thereof, and air may flow through the plurality of holes.

The first flow path 161 is a flow path along which air is discharged from the main drum 140 to the outside, and the second flow path 162 is a flow path along which air is discharged from the sub drum 200 to the outside.

An exhaustion flow path is a flow path where the first flow path 161 and the second flow path 162 meet with each other, and a filter unit 170 configured to filter foreign materials included in air may be disposed at the exhaustion flow path.

The first flow path 161 and the second flow path 162 may be formed close to each other. The dryer may further include the damper unit 180 configured to selectively open and close one of the first flow path 161 and the second flow path 162.

The damper unit 180 may be formed at the door portion adjacent to the exhaustion flow path. However, the present invention is not limited to such a position. That is, the damper unit 180 may be installed on any position where one of the first flow path 161 and the second flow path 162 is selectively open and closed.

In a case where an object to be dried is accommodated only in the sub drum 200, the first flow path 161 may be blocked as shown in FIG. 4A, such that air flow is concentrated to the sub drum 200. This may enhance drying efficiency inside the sub drum 200. In some cases when an object to be dried is accommodated in the main drum 140, both the first flow path 161 and the second flow path 162 may be open as shown in FIG. 4B, such that an air flow area is increased. This may increase the amount of air introduced into the main drum 140.

Figure 5A:
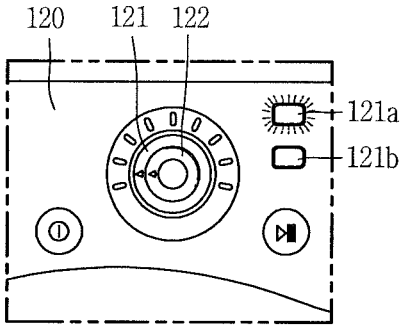
FIGS. 5A and 5B are conceptual views illustrating an example state of a control panel unit and a blocked state of a second flow path by a damper unit, respectively, when a main drum is driven.
Figure 5B:
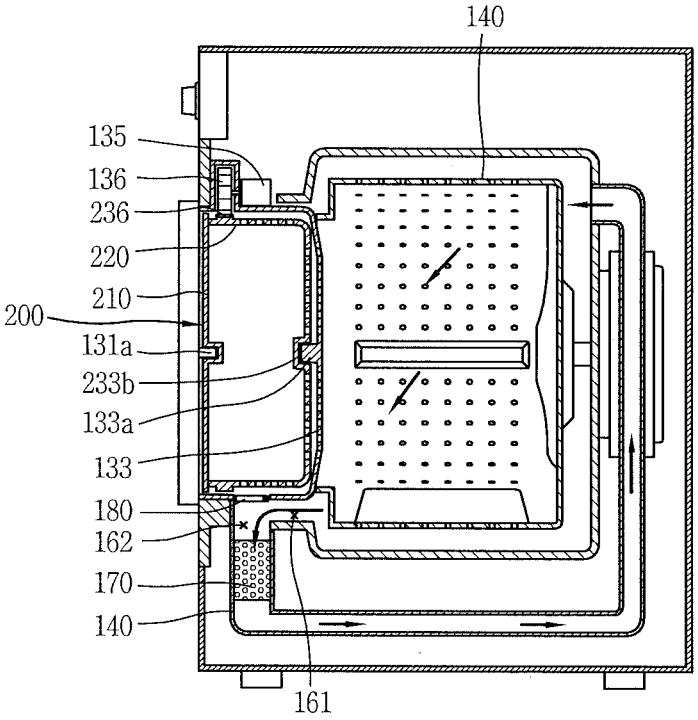

FIG. 5A illustrates an example state of a control panel unit, and FIG. 5B illustrates an example blocked state of the second flow path 162 by the damper unit 180.

The cabinet may further include a control panel unit 120 disposed above the opening and formed to be manipulated by a user. The control panel unit 120 may include a first dial 121 for setting a drying mode of the main drum 140, and a second dial 122 for setting a drying mode of the sub drum 200. The first and second dials 121, 122 may be formed to be rotatable independently. As each of the first and second dials 121, 122 is rotated, various drying modes may be selected.

The first and second dials 121, 122 may be formed to be rotatable by a user's manipulation, and may be disposed to be concentric with each other. This may provide an aesthetic effect and may allow a user to recognize an operation state of the control panel unit 120 in an intuitive manner.

The control panel unit may further include a first LED 121*a* turned on and off in response to an operation of the first dial, and a second LED 122*a* turned on and off in response to an operation of the second dial. When both the first and second dials are disposed in a drying mode, the first and second LEDs 121*a*, 122*a* may be turned on.

Referring to FIG. 5A, the first dial for selecting a drying mode of the main drum 140 may be set to select one of drying modes. Then, the first LED may be turned on.

Referring to FIG. 5B, an object to be dried may be accommodated in the main drum 140. The damper unit 180 may be rotated to block the second flow path 162 such that air is discharged to the outside along the first flow path 161, at a rear side of the main drum 140. in some cases, as shown earlier in FIG. 4B, the damper unit 180 may be rotated to open both the first flow path 161 and the second flow path 162, such that an area of the flow path along which air flows is increased.

Figure 6A:
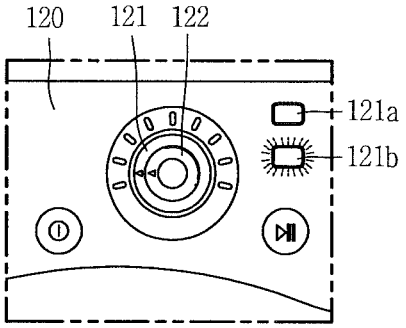
FIGS. 6A and 6B are conceptual views illustrating an example state of a control panel unit and a damper unit, respectively, when only a sub drum is driven.
Figure 6B:
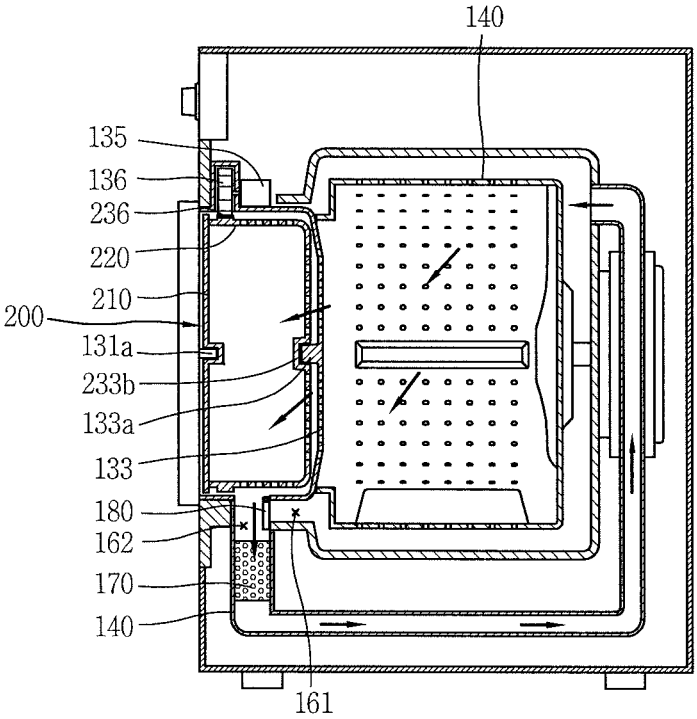

FIGS. 6A and 6B are conceptual views illustrating an example state of the control panel unit and the damper unit 180, respectively, when only the sub drum 200 is driven.

Referring to FIGS. 6A and 6B, the damper unit 180 may be rotated to block the first flow path 161 when an object to be dried is accommodated in only the sub drum 200.

The second dial 122 may be formed to control a temperature of air introduced into the sub drum 200. Such temperature control may be utilized, for example, when an object to be dried has a comparatively smaller volume to be accommodated in the sub drum 200, and the object to be dried includes an object that should be dried at a low temperature (e.g., silk).

Figure 7A:
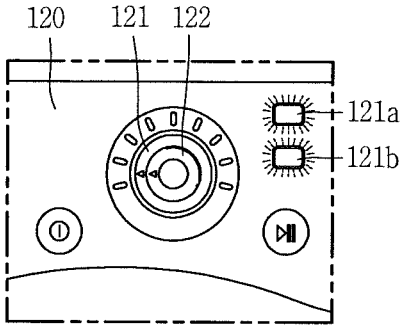
FIGS. 7A and 7B are conceptual views illustrating a state of a control panel unit and a damper unit, respectively, when both a main drum and a sub drum are driven.
Figure 7B:
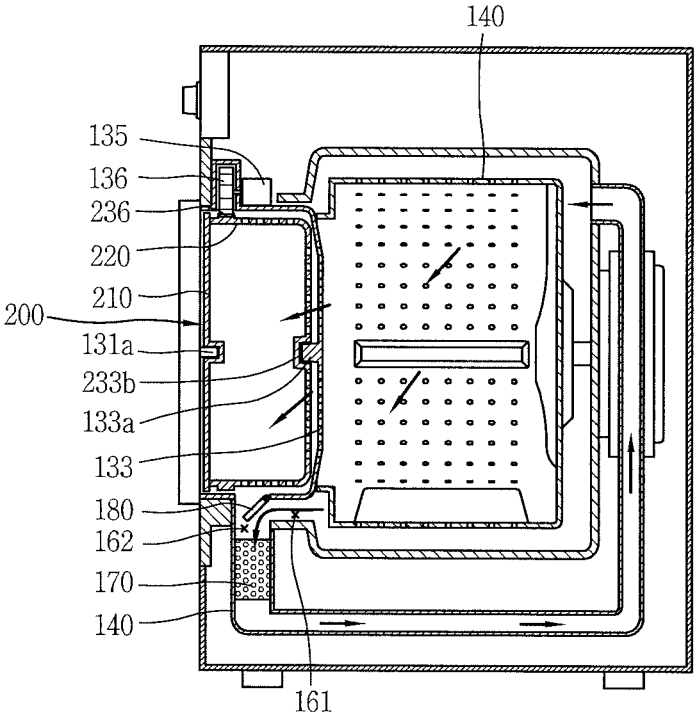

FIGS. 7A and 7B are conceptual views illustrating an example state of the control panel unit and the damper unit 180, respectively, when both the main drum 140 and the sub drum 200 are driven.

Referring to FIGS. 7A and 7B, the main drum 140 and the sub drum 200 may be provided with motors for rotating the main drum 140 and the sub drum 200, and may be formed to be rotatable at different speeds when the first and second dials 121, 122 are manipulated. Accordingly, the sub drum 200 may be rotated at a lower speed than the main drum 140.

An object to be dried may be accommodated in both the main drum 140 and the sub drum 200. And both the first dial and the second dial are in a drying mode. As a result, both the first LED and the second LED are turned on, and the damper unit 180 opens both the first flow path 161 and the second flow path 162.

According to the present disclosure, since an object to be dried having a comparatively smaller volume can be accommodated in the sub drum 200, a drying operation suitable for the sub drum 200 may be performed at a space separated from the main drum.

Moreover, since air flow can be selected as the damper unit opens and closes one of the first and second flow paths or both the first and second flow paths, drying efficiency and energy efficiency may be enhanced.

As the present features may be implemented in several forms without departing from the characteristics thereof, it should also be understood that the above-described examples are not limited by any of the details of the foregoing description, unless otherwise specified, but rather should be construed broadly within its scope as defined in the appended claims. Therefore, all changes and modifications that fall within the metes and bounds of the claims, or equivalents of such metes and bounds, are therefore intended to be embraced by the following claims.

What is claimed is:

1. A dryer comprising:

a cabinet that defines an outer appearance of the dryer and has an opening;

a main drum rotatably disposed in the cabinet and configured to accommodate an object to be dried;

a door portion coupled to the cabinet and configured to open and close the opening of the cabinet, wherein the door portion includes:

a motor coupled to a side of the door portion and configured to generate a rotational force, a gear unit having a saw teeth shape, the gear unit being connected to an end part of the motor and configured to be rotated by the motor, and a sub drum rotatably mounted to the door portion and extending toward an inner space of the cabinet, the sub drum defining an accommodation space that is separated from an inner space of the main drum, wherein the sub drum includes a sub drum gear located at an outer circumferential surface of the sub drum, the sub drum gear being configured to be engaged with and rotated by the gear unit;

a first passage defining a first flow path along which air is discharged out of the main drum;

a second passage defining a second flow path along which air is discharged out of the sub drum;

an exhaustion passage defining an exhaustion flow path where outlets of the first and second flow paths meet; and a damper unit that is rotatably mounted in the exhaustion flow path, the damper unit being configured to selectively open and close each outlet of the first flow path and the second flow path.

2. The dryer of claim 1, wherein the door portion includes:

a lid member having a front window; and an accommodation member hinge-coupled to the lid member and defining a space for accommodating the sub drum, the accommodating member being configured to open and close the opening of the cabinet.

3. The dryer of claim 1, wherein the sub drum is configured to be detachably mounted to the lid member and the accommodation member.

4. The dryer of claim 3, wherein the lid member includes a rotation protrusion protruding toward the inner space of the cabinet, and wherein the sub drum includes a protrusion accommodation portion that corresponds to the rotation protrusion, the protrusion accommodation portion being configured to rotatably receive the rotation protrusion.

5. The dryer of claim 1, further comprising a filter unit disposed at the exhaustion flow path and configured to filter foreign materials from the air discharged out of the first and second flow paths.

6. The dryer of claim 1, wherein the damper unit is configured to open the second flow path based on the object to be dried being accommodated in the main drum, such that an area of air flow is increased compared to the second flow path being closed.

7. The dryer of claim 1, wherein the damper unit is configured to block the first flow path based on the object to be dried being accommodated in only the sub drum.

8. The dryer of claim 1, wherein the cabinet further includes a control panel unit disposed above the opening and configured to be manipulated by a user, and wherein the control panel unit includes a first dial for setting a drying mode of the main drum, and a second dial for setting a drying mode of the sub drum.

9. The dryer of claim 8, wherein the first and second dials are configured to be rotatable by a user's manipulation, and wherein the first and second dials are disposed to be concentric with each other.

10. The dryer of claim 8, wherein the control panel unit further includes:

a first LED configured to be turned on and off in response to an operation of the first dial; and a second LED configured to be turned on and off in response to an operation of the second dial, and wherein the first and second LEDs are configured, based on both the first and second dials being set to the drying mode, to be turned on.

11. The dryer of claim 8, wherein the main drum and the sub drum are configured to be rotatable at different speeds from each other.

12. The dryer of claim 11, wherein the second dial is configured to control a temperature of air introduced into the sub drum.

13. The dryer of claim 1, wherein the damper unit is configured to block the second flow path based on the object to be dried being accommodated in only the main drum.

14. The dryer of claim 3, wherein the main drum is configured to receive air to dry the object to be dried, and wherein a rear surface of the accommodation member defines a plurality of holes, the plurality of holes being configured to allow passage of the air from the main drum to the accommodation member.

15. The dryer of claim 14, wherein the sub drum defines a plurality of holes that are configured to allow passage of air from the air from the main drum to the sub drum.

16. The dryer of claim 14, wherein rear or side surfaces of the sub drum defines a plurality of holes that are configured to allow passage of the air from the main drum to the sub drum.

17. The dryer of claim 1, wherein the main drum and the sub drum are configured to be operated simultaneously.

18. The dryer of claim 1, wherein the main drum and the sub drum are configured to be operated independently from each other.

19. A dryer comprising:

a cabinet that defines an outer appearance of the dryer and has at least one opening;

a main drum rotatably disposed in the cabinet and configured to accommodate an object to be dried;

a door portion coupled to the cabinet and configured to open and close the opening of the cabinet;

a sub drum rotatably mounted to the door portion and extending toward an inner space of the cabinet, the sub drum defining an accommodation space that is separated from the inner space of the main drum;

a main motor configured to generate a rotational power for rotating the main drum; and a sub motor coupled to a side of the door portion and configured to generate a rotational force for rotating the sub drum.

20. The dryer of claim 19, further comprising a damper unit configured to selectively open and close one of a first outlet through which air from the main drum is discharged and a second outlet through which air from the sub drum is discharged.

* * * * *